US011219812B2

(12) United States Patent
Westbrooks

(10) Patent No.: US 11,219,812 B2
(45) Date of Patent: Jan. 11, 2022

(54) SYSTEMS AND DEVICES FOR TRAINING A TENNIS SERVE

(71) Applicant: Phillip V Westbrooks, Phoenix, AZ (US)

(72) Inventor: Phillip V Westbrooks, Phoenix, AZ (US)

( * ) Notice: Subject to any disclaimer, the term of this patent is extended or adjusted under 35 U.S.C. 154(b) by 0 days.

(21) Appl. No.: 16/698,720

(22) Filed: Nov. 27, 2019

(65) Prior Publication Data

US 2021/0154554 A1 May 27, 2021

(51) Int. Cl.
*A63B 69/38* (2006.01)
*A63B 71/06* (2006.01)

(52) U.S. Cl.
CPC ..... *A63B 69/385* (2013.01); *A63B 71/0622* (2013.01); *A63B 2071/0658* (2013.01); *A63B 2220/833* (2013.01); *A63B 2225/093* (2013.01)

(58) Field of Classification Search
CPC ..... A63B 69/385; A63B 71/0622; A63B 2220/833; A63B 2071/0658; A63B 2225/093
USPC ..... 473/459, 461, 462, 473, 474
See application file for complete search history.

(56) References Cited

U.S. PATENT DOCUMENTS 2,845,244 A * 7/1958 Prokop ..... F16M 11/18 248/171
3,490,769 A * 1/1970 Torbett ..... A63B 63/007 473/196
3,834,548 A * 9/1974 Cliffton ..... A47G 25/54 211/118
4,796,886 A * 1/1989 Loh ..... A63B 63/00 273/401
5,011,143 A * 4/1991 Jones ..... A63B 69/385 473/459
5,709,620 A * 1/1998 Reinprecht ..... A63B 63/007 434/247
5,830,076 A * 11/1998 Borys ..... A63B 57/40 473/173
6,450,464 B1 * 9/2002 Thomas ..... F16M 11/34 248/163.1
7,281,691 B2 * 10/2007 Adelman ..... A61M 5/1414 248/125.8
7,740,550 B1 * 6/2010 Kaufman ..... A63B 69/385 473/459
8,801,548 B2 * 8/2014 Swingle ..... A63B 69/38 473/462
2003/0154903 A1 * 8/2003 Rakowski ..... G01L 1/24 116/203
2006/0086869 A1 * 4/2006 Hsieh ..... F16M 11/046 248/171
2008/0283692 A1 * 11/2008 Leinen ..... A61M 5/1415 248/125.8

* cited by examiner

*Primary Examiner* — Nini F Legesse
(74) *Attorney, Agent, or Firm* — KW Law, LLP

(57) ABSTRACT

A tennis training system may include a target mat including an intersection point and radial lines extending from the intersection point to visibly define sections. A target device may align with the target mat. The target device may include a body, a target assembly coupled to a first end of the body to define a target opening, and a base coupled to a second end of the body opposite the first end.

13 Claims, 15 Drawing Sheets

SYSTEMS AND DEVICES FOR TRAINING A TENNIS SERVE

FIELD

The present disclosure relates to systems and devices for training a tennis serve. In particular, the present disclosure relates to systems and devices to train the tennis serve with focus on the movement and accuracy of the vertical toss.

BACKGROUND

Practice makes novices athletes into better players in all sports, tennis included. The beginning tennis player can spend time on basic competencies by absorbing rules, gripping his racket, refining footwork, grooving the swing, and mastering the serve. The novice player works on the many components of the serve then puts them together in a final product. The toss is one of those components.

Coaching can help a player master his or her tennis toss, and training aids can generally improve the efficiency of coaching or enable players to work on skills alone. Tennis toss aids available in the market typically function with a coach or partner to hold and manually position the training aid during use. Results with the hand-held aid may be inconsistent because the training partner holding and manually positioning the training aid can unintentionally shift for each toss. Small movements can cause a meaningful shift on the target that renders the try counterproductive for learning. Such training aids are thus ineffective to use with assistance and difficult to use alone.

SUMMARY

Tennis training systems and devices of the present disclosure may include a target mat having an intersection point and radial lines extending from the intersection point to visibly define sections, in accordance with various embodiments. A target device may align with the target mat. The target device may have a body, a target assembly coupled to a first end of the body to define a target opening, and a base coupled to a second end of the body opposite the first end.

In various embodiments, the system may include a bracket configured to slide along the body between a first position and a second position. A leg may be hingedly coupled to the bracket and may translate into a deployed configuration in response to the bracket translating into the second position. A retention clip may be coupled to the body and configured to retain the bracket in the second position. The retention clip may include a spring segment and a retention segment coupled to the spring segment. The retention segment may release the bracket in response to the retention segment translating towards the body. The base may have a support member hingedly coupled to the body and hingedly coupled to a central portion of the leg. The body may include a telescoping mechanism including an outer stage, an inner stage, and a plunger stage. The plunger stage may include a neck slidably engaged with the inner stage and head assembly with a first side of the head assembly pivotally coupled to the neck. The target assembly may be disposed at a distal end of the head assembly. The head assembly may be cantilevered from the neck to position the target opening of the target assembly over the target mat in a deployed configuration.

A target device may include a body, a head assembly coupled to a first end of the body and defining a target opening, and a bracket configured to translate along the body from a first position to a second position, in accordance with various embodiments. A first leg may be hingedly coupled to the bracket. The first leg may translate into a deployed configuration in response to the bracket translating into the second position. A retention clip may be coupled to the body to retain the bracket in the second position. The retention clip may include a spring segment and a retention segment coupled to the spring segment. The retention clip may release the bracket in response to the retention segment translating towards the body.

In various embodiments, the body may have a square cross section. A second leg may be hingedly coupled to the bracket and may translate into the deployed configuration in response to the bracket translating into the second position. The second leg may protrude from the body at a 90-degree angle relative to the first leg in the deployed configuration. A foot may be hingedly coupled to a distal end of the first leg. The foot may be a cuboid made from metal with a layer of rubber disposed over the cuboid. The body may be made from a polymer. The body may also have a telescoping mechanism having an outer stage, an inner stage disposed at least partially in the outer stage, and a plunger stage disposed at least partially in the inner stage. The plunger stage may include a neck pivotally coupled to the head assembly and slidably engaged with the inner stage. A target assembly may be disposed at a distal end of the head assembly to define the target opening. A top clip may be coupled to a distal end of the neck to retain the head assembly cantilevered from the neck.

A target mat may include a plurality of radial lines extending from an intersection point to define sections, in accordance with various embodiments. An edge of the target mat may be bordered by a first radial line and a second radial line with the first radial line oriented 180 degrees from the second radial line. A plurality of segments may extend between distal ends of the plurality of radial lines, and the plurality of segments and the edge may define a perimeter of the target mat. The target mat may further include a visual indicator to signal a tennis ball landing on a contact location.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the illustrations.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the inventions, it should be understood that other embodiments may be realized, and that logical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
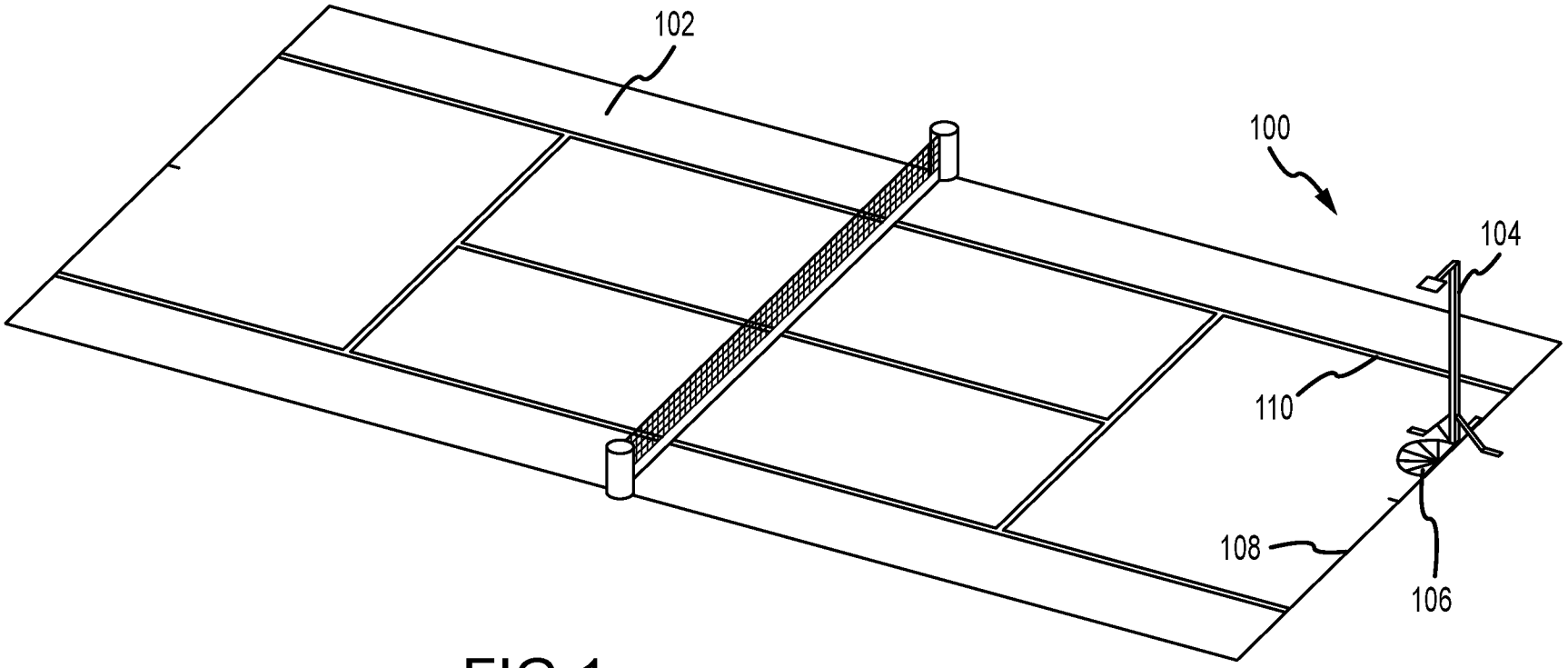
FIG. 1 illustrates a perspective view of a tennis training system deployed on a tennis court, in accordance with various embodiments.

With reference to FIG. 1, training system 100 is shown deployed on tennis court 102 marked with baseline 108, sideline 110, and service line 112, in accordance with various embodiments. Training system 100 comprises a target device 104 aligned with baseline 108 of tennis court 102. Training system 100 further comprises a target mat 106 aligned on tennis court 102 with baseline 108, adjacent target device 104, and set off from service line 112 by approximately 2 feet. Although training system 100 is shown offset from baseline 108 by approximately 2 feet, other distances or alignments may be suitable for training based on size and location of target mat 106 and target device 104.

Figure 2A:
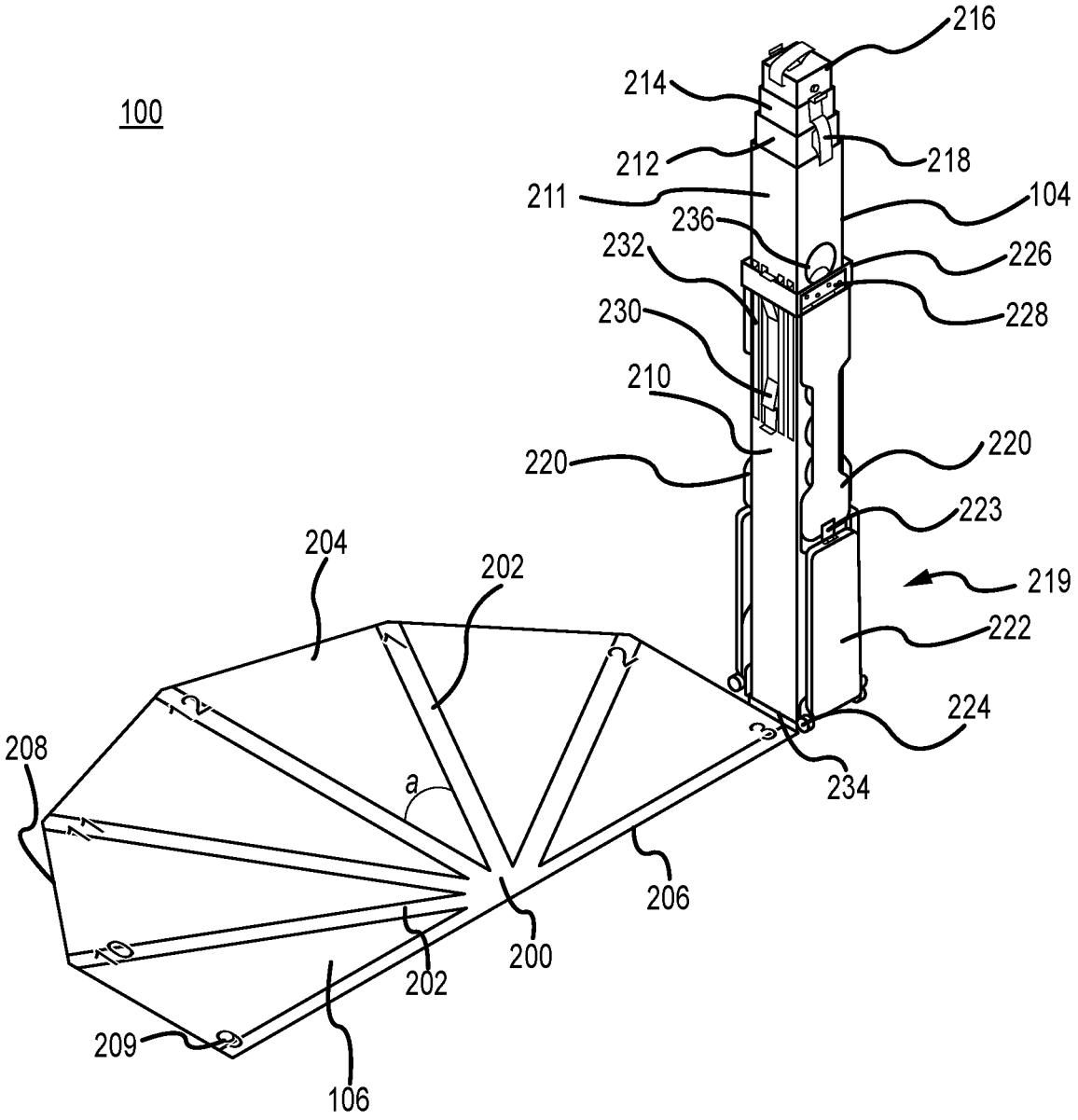
FIGS. 2A and 2B illustrate perspective views of a tennis training system with a target device in a stowed configuration and a target mat deployed adjacent the stowed target device, in accordance with various embodiments.
Figure 2B:
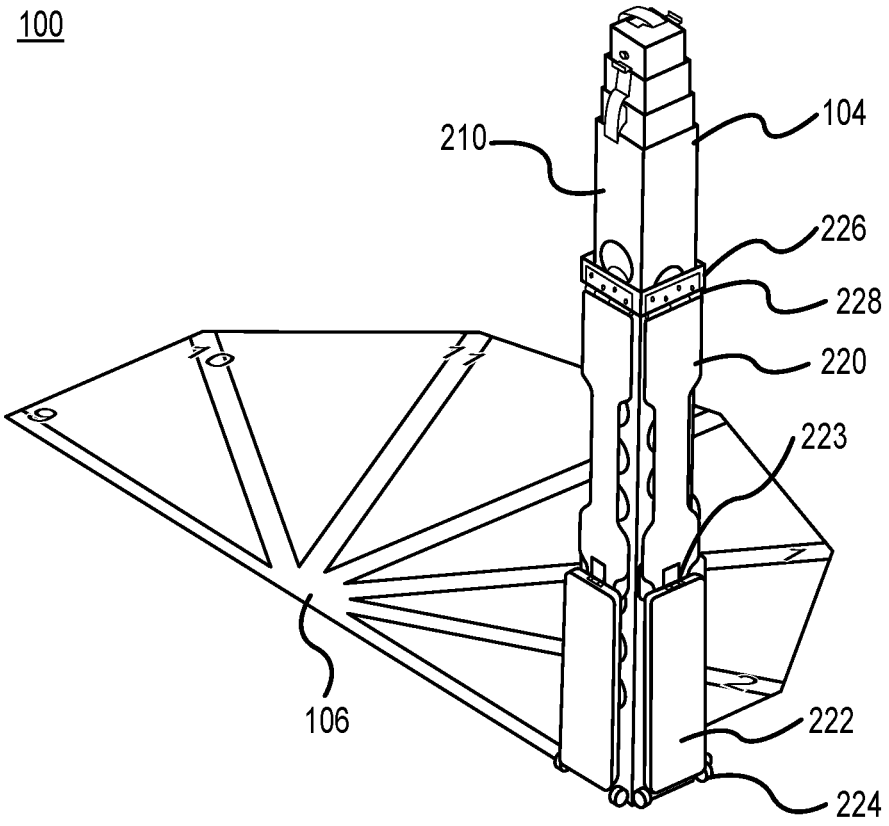

With reference to FIGS. 2A and 2B, training system 100 is shown with target device 104 in a stowed state and target mat 106 deployed adjacent target device 104, in accordance with various embodiments. Target mat 106 may comprise intersection point 200 where radial lines 202 on surface 204 of target mat 106 intersect. Radial lines 202 may divide a visible surface of target mat 106 into sections. Intersection point 200 may be disposed along edge 206 of target mat 106, and edge 206 may be parallel to and/or aligned with baseline 108 of tennis court 102 (of FIG. 1) to deploy tennis training system 100 for use.

In various embodiments, radial lines 202 and intersection point 200 may be embedded, printed, molded, etched, or otherwise formed in or on target mat 106 to create visible sections. Radial lines 202 may be formed with an angle $\alpha$ between each adjacent radial line 202. Angle $\alpha$ between adjacent radial lines 202 may be equal, or angle $\alpha$ may vary between radial lines 202 according to various embodiments. For example, angle $\alpha$ may be 30 degrees +/−5 degrees, +/−10 degrees, +/−15 degrees, or any other suitable angle between two adjacent radial lines 202.

In various embodiments, angle $\alpha$ of 30 degrees may result in radial lines 202 arranged to approximate clock positions 209. Radial line 202 of target mat 106 arranged perpendicular to baseline 108 of tennis court 102 (of FIG. 1) and parallel to sideline 110 of tennis court 102 may be marked as 12 in reference to the position on a clock. Radial lines 202 that extend along edge 206 to intersection point 200 may be marked as 9 and 3 at the distal ends, with 3 being clockwise from 12, and with 9 being counterclockwise from 12. In that regard, the radial lines 202 marked 9 and 3 may be oriented at substantially 180 degrees relative to one another such that the radial lines 202 border edge 206. As used herein with reference to angles, substantially means an angle may vary by plus or minus 1 degree, 2 degrees, 3 degrees, 4 degrees, or 5 degrees.

In various embodiments, each radial line 202 between the clock positions 209 at 9, 12, and 3 may be disposed at angle $\alpha$ relative to the immediately adjacent radial line 202 and marked with a sequential clock position 209 (e.g., 9, 10, 11, 12, 1, 2, 3). Segments 208 may extend between radial lines 202 and define the perimeter of target mat 106 opposite edge 206. Segments 208 may be straight, curved, irregular, or formed in any other suitable shape to define the perimeter of target mat 106. The entire perimeter of target mat 106 may be defined by six segments 208 and edge 206. In that regard, target mat 106 may resemble the top half of a clock divided along its diameter from 9 o'clock to 3 o'clock. Although sections of target mat 106 are depicted as triangular regions defined by segment 208 and radial lines 202, other shaped and sized sections may also be suitable to use in target mat 106 as visual indicators of desired landing locations.

In various embodiments, target mat 106 may comprise visual indicators to signal the contact point where a ball lands or should land on target mat 106. Visual indicators may be passive or active. Passive visual indicators may not change in response to contact with a ball. Passive visual indicators may include, for example, the sections created by radial lines 202 on target mat 106 suitable for locating the tennis ball on target mat 106 at the moment of impact.

In various embodiments, active visual indicators may change temporarily or permanently in response to contact with a ball so that a player or coach can easily identify the point of contact between a ball and target mat 106. For example, active visual indicators of target mat 106 may include impact tape or other replaceable material disposed on the surface of target mat 106 that leaves a visual indicator at a contact location after a ball strikes target mat 106. Active indicators may also include LED backlighting disposed in in target mat 106 that selectively illuminates sections of target mat 106 struck by a ball for a predetermined duration in response to the ball contacting the surface of training mat 106. Lighting may illuminate a section formed by radial lines 202 or another suitable portion of target mat 106 to give a player feedback as to which location on target mat 106 contacted a ball. Stated another way, sections of target mat 106 may be selectively illuminated in response to contact with a ball. Other examples of active visual indicators may include a powder or liquid substance disposed on the surface of target mat 106 or on a ball such that the substance is disturbed after contact with a ball, thus leaving a visual indicator of contact on target mat 106.

In various embodiments, target mat 106 may also comprise audible indicators of contact. For example, target mat 106 may include a speaker and power unit configured to produce an active auditory indicator in response to contact with a ball. The speaker may make a first sound in response to a ball striking a desirable portion of target mat 106. The speaker may make a second sound in response to a ball striking an undesirable portion of target mat 106. Similarly, target mat 106 may be formed with sections that passively generate different sounds in response to contact with a ball. For example, sections between the radial line 202 at 11 o'clock and the radial line 202 at 1 o'clock may be formed with a rigid- or semi-rigid surface over a hollow chamber to create a drum-like sound in response to contact with a ball, while other sections may be filled solid to create a deadened or nearly inaudible sound in response to contact with a ball.

FIGS. 2A and 2B also depict target device 104 in a stowed configuration with telescoping stages of body 210 fully retracted, in accordance with various embodiments. Body 210 of target device 104 may comprise outer stage 211, first inner stage 212 nested within outer stage 211, second inner stage 214 nested within first inner stage 212, and plunger stage 216 nested within second inner stage 214. Each stage of body 210 may slidably engage adjacent stages such outer stage 211 may slidably engage first inner stage 212, first inner stage 212 may slidably engage second inner stage 214, and second inner stage 214 may slidably engage plunger stage 216. In that regard, body 210 may extend into a deployed configuration or retract into a stowed configuration using a telescoping mechanism. Each stage of body 210 may have a square-shaped cross section as depicted, though other cross-sectional shapes such as circular, triangular, rounded, hexagonal, irregular, or other cross-sectional profiles may be suitable to facilitate telescoping engagement between nested stages of body 210.

In various embodiments, body 210 may include a bottom pad 234 with one edge parallel to a segment 208 of mat 106 to facilitate alignment. Bottom pad 234 have an edge uncovered by legs 220 to allow target mat 106 to align close to or in contact with bottom pad 234 of body 210. Bottom pad 234 may comprise a layer of plastic, rubber, or other material suitable to contacting tennis court 102 (of FIG. 1) without damaging the surface.

In various embodiments, base 219 may comprise legs 220 hingedly coupled to feet 222. Legs 220 may lie flat against body 210 in a stowed configuration with feet 222 folded against legs 220 and retained against legs 220 by clip 223. Feet 222 may be thin cuboids suitable for folding against legs 220. Legs 220 may be thin, elongated protrusions coupled to body 210 and suitable to lying flat against body 210 in a stowed configuration. Legs 220 may be coupled to bracket 226 by hinge 228, and bracket 226 may be disposed on and/or around body 210. Wheels 224 may be coupled to legs 220 to allow leg to roll against a surface as legs translate into a deployed configuration. Slides 232 may protrude from body 210 and slidably engage bracket 226 to create a gap between bracket 226 and body 210. Retention clip 230 may be coupled to body 210 between slides 232 to retain bracket 226 in stowed or deployed positions. Retention clip 230 may depress into the gap created by slides 232 between bracket 226 and body 210 to release bracket 226 from the stowed or deployed positions. Openings 236 may be formed through body 210 to reduce the weight of target device 104.

In various embodiments, various components of target device 104 may be made or manufactured from a polymer material. Suitable Polymer materials may include, for example, high density polyethylene (HDPE), acrylonitrile butadiene styrene (ABS), polypropylene (PP), polyester (PES), polyethylene terephthalate (PET), polyvinyl chloride (PVC), polyamides (PA) including various nylons, polyethylene/acrylonitrile butadiene styrene (PE/ABS), and polycarbonate (PC), polycarbonate/acrylonitrile butadiene styrene (PC/ABS), as well as various resins or materials compatible with various additive manufacturing processes and/or 3D printers, such as Stratasys PolyJet materials. Composite materials such as aramid fiber-, carbon fiber-, graphite fiber-, or graphene fiber-reinforced polymers may be formed with resin or other moldable material to enhance strength and maintain a light-weight construction.

In various embodiments, target device 104 may comprise natural materials such as wood, bamboo, hemp- or algal-based biopolymers, and the like. Natural materials can be used in a composite material, for example, a wood and adhesive laminate (i.e., plywood). In various embodiments comprising a laminated material, layers may be oriented such that the layer arrangement is visible in a side view. In various embodiments comprising laminate wood or plywood, the grains of the veneers may be configured to affect a suitable level of rigidity. Likewise, target device 104 may comprise metals or metal alloys including steel, titanium, chromium, cobalt-chrome, stainless steel, aluminum, and the like. For example, the various retention clips disclosed herein for use in target device 104 may be suited to metal materials to increase strength, provide a suitable spring constant, and reduce fatigue resultant from flexion. Selective use of metal materials may also result in a light-weight construction of target device 104 in various embodiments. Components of base 219, body 210, or the various retention clips described herein may be suitably formed using various techniques and metal forms such as, for example, stamped sheet metal, cast metal, bent metal, or turned metal.

In various embodiments, target mat 106 may also be made or manufactured from a variety of materials including, for example, textiles, rubbers, plastics, natural fibers, manmade fibers, wood, or other suitable materials. Flexible materials may allow target mat 106 to fold, roll, or otherwise stow into a portable configuration. Rigid materials may be suitable for target mat 106 with flexible materials binding rigid sections to allow for folding, rolling, or otherwise stowing target mat 106.

Figure 3A:
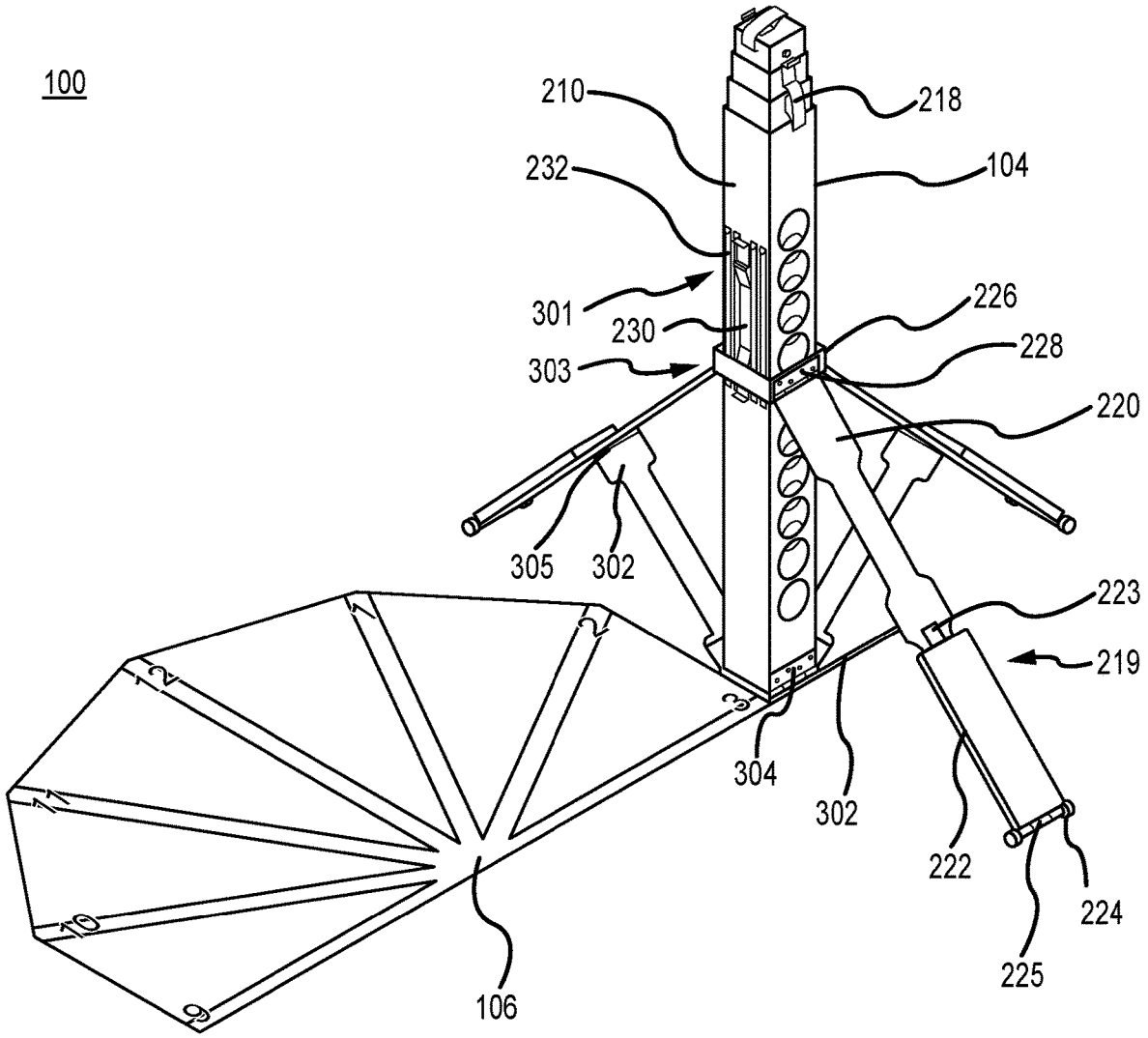
FIGS. 3A and 3B illustrate perspective and elevation views, respectively, of a tennis training system having a target device with a body in a stowed configuration and a base in a deployed configuration, in accordance with various embodiments.
Figure 3B:
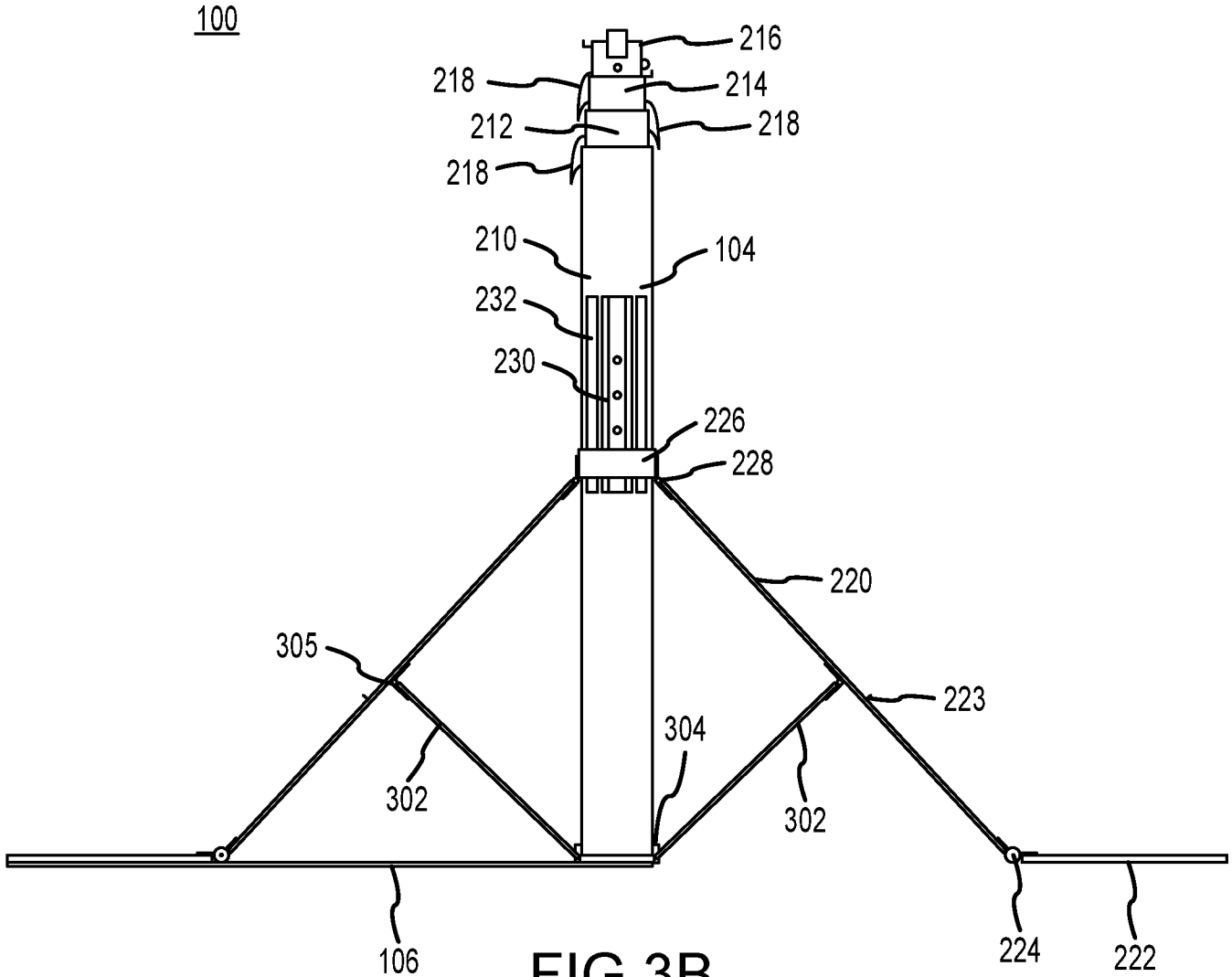

Referring now to FIGS. 3A and 3B, tennis training system 100 is shown with body 210 of target device 104 in a stowed configuration and base 219 of target device 104 in a deployed configuration, in accordance with various embodiments. Base 219 comprises legs 220 coupled to bracket 226 by hinge 228 so that hinge 228 may translate from a flat configuration into an angled configuration in response to bracket 226 sliding from stowed position 301 into deployed position 303. Legs 220 may translate from a stowed configuration flat against body 210 into a deployed configuration away from body 210 in response to bracket 226 translating from stowed position 301 to deployed position 303. Wheels 224 may roll away from body 210 as legs 220 translate into the deployed configuration. Base 219 may include support members 302 hingedly coupled to a central portion of legs 220 by hinge 305. Support members 302 may also be hingedly coupled to body 210 by hinge 304. Support member 302 may translate away from body 210 by rotating about the axis of hinge 304 in response to bracket 226 sliding into deployed position 303.

As shown in FIG. 3B and according to various embodiments, leg 220, support member 302, and body 210 may form a triangular support structure of base 219 in a deployed configuration in response to bracket 226 translating into the deployed position 303. Support member 302 may meet leg 220 at a substantially 90-degree angle or any other suitable angle to support leg 220 in a deployed configuration. Feet 222 may release from clip 223 and pivot about hinge 225 into a deployed position lying flat against tennis court 102 (of FIG. 1) or another surface. Feet 222 may comprise a layer of rubber or plastic disposed over a surface to increase friction with and reduce damage to tennis court 102. Feet 222 may be made of a heavier material than other components of target device 106 to serve as a ballast for target device 104. For example, feet 222 may be formed using aluminum or another metallic material, and body 210 may be formed using a lighter material such as molded plastic. In windy conditions or when additional stability is desired, additional weight may be placed above feet 222 to increase the force between tennis court 102 and rubber base of feet 222 thereby increasing friction. Weight placed on top of feet 222 may also hold feet 222 down on the surface of tennis court 102 with greater stability.

Figure 3C:
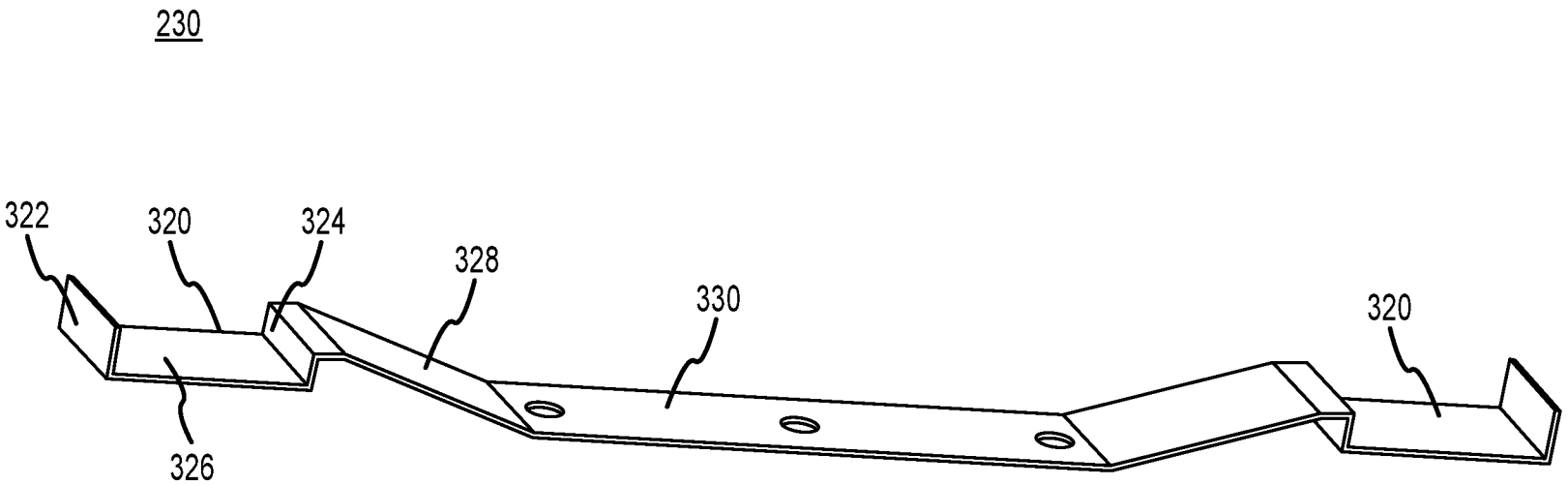
FIG. 3C illustrates a perspective view of the retention clip of the target device of FIGS. 3A and 3B, in accordance with various embodiments.

FIG. 3C depicts retention clip 230 in perspective view, in accordance with various embodiments. Retention clip 230 may be symmetric with retention zones 320 disposed at distal ends corresponding to stowed position 301 of FIG. 3A and deployed position 303 of FIG. 3A. Each retention zone 320 of retention clip may be defined by outer retention wall 322, retention floor 326 extending from outer retention wall 322 at a nonzero angle, and inner retention wall 324 extending from retention floor 326 at a nonzero angle. Retention zones 320 of retention clip 230 may comprise a shape suited to receive bracket 226 and retain bracket 226 in either stowed position 301 or in deployed position 303.

Referring to FIGS. 3A through 3C, spring segment 328 may flex in response to pressure applied between center body 330 of retention clip 230 and outer retention wall 322. Spring segment may be configured to flex towards body 210 and depress retention zone 320 towards body 210 to release bracket 226.

In various embodiments, jack clips 218 may be coupled to telescoping stages of body 210 and configured to engage adjacent stages. The retention mechanism of jack clip 218 is described in greater detail below. Although body 210 is depicted with a telescoping mechanism held in position by jack clips 218, body 210 may also be fixed, folding, stowable, permanent, or any other configuration suitable to arrange a target head over a target mat.

Figure 4A:
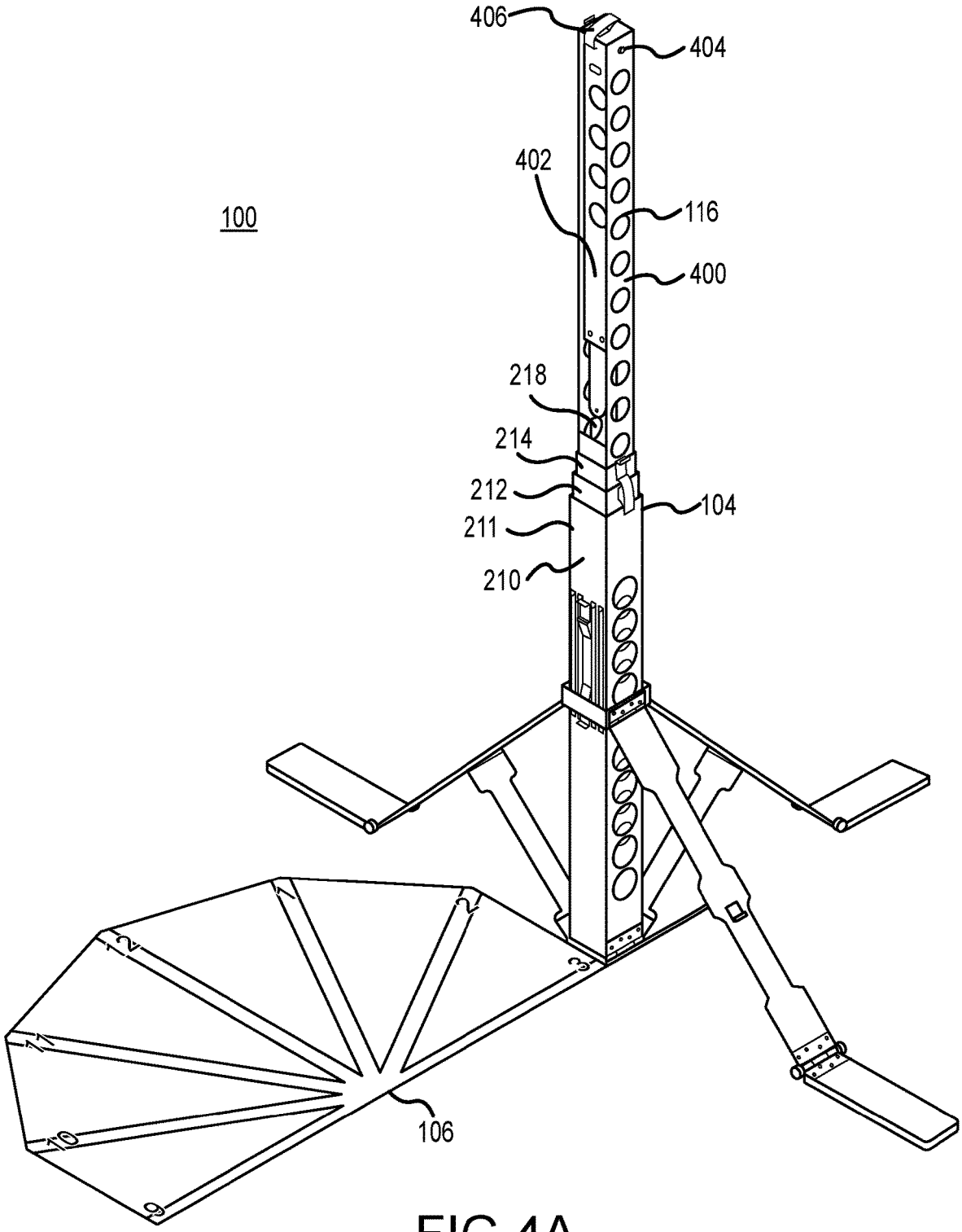
FIGS. 4A and 4B illustrate perspective views of a target device having a plunger stage of a telescoping body in a deployed configuration, in accordance with various embodiments.
Figure 4B:
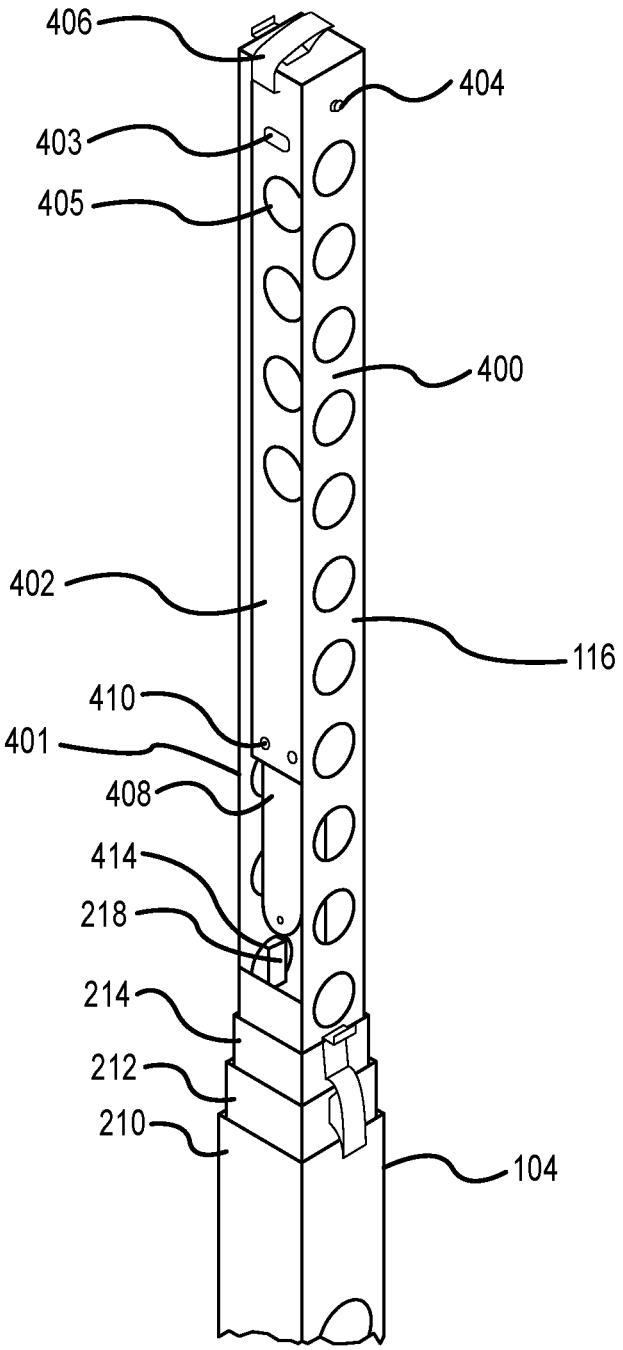

Referring now to FIGS. 4A and 4B, a target device 104 is shown with plunger stage 116 of body 210 in a deployed configuration extending out from second inner stage 214, in accordance with various embodiments. Although body 210 is depicted with second inner stage 214 and first inner stage 212 nested within outer stage 211, stages of body 210 may be deployed or retracted in any order. Jack clip 218 may retain plunger stage 216 in a fully or partially deployed state and extending from second inner stage 214 by engaging an opening 414 formed through neck 400 of plunger stage 216. Openings 414 may have any suitable shape suitable to engage jack spring 218 including, for example, circular, square, rectangular, hexagonal, polygonal. Openings 414 may be formed completely or partially through neck 400 of plunger stage 216. Openings 414 may be formed on one or more side of neck 400 to reduce the weight of target device 104 relative to various embodiments with fewer openings 414. The height of target device 104 may be adjusted by selecting a different opening 414 of neck 400 to engage jack clip 218. Jack clip 218 may retain neck 400 at a selected height of deployment relative to second inner stage 214 by resisting the telescoping action of body 210.

Figure 4C:
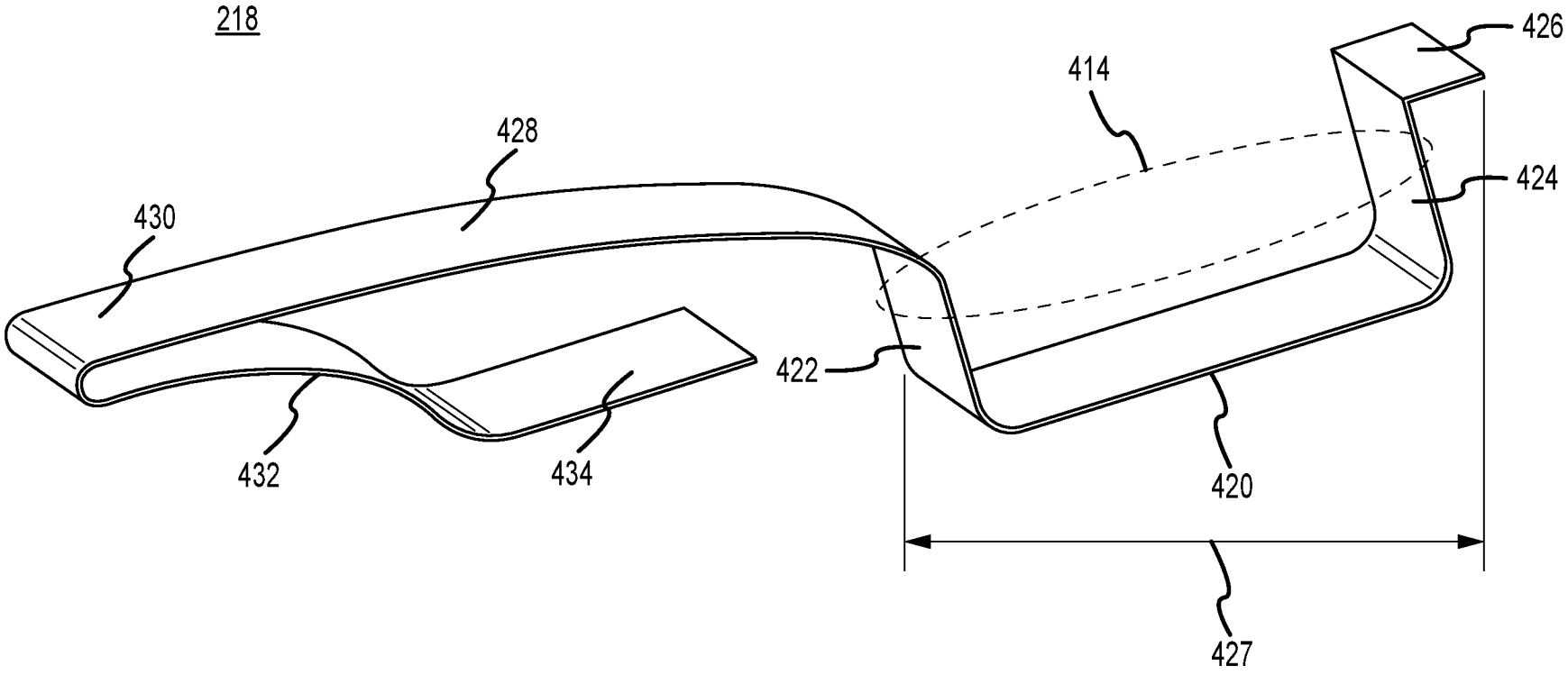
FIG. 4C illustrates a jack spring of the target device depicted in FIGS. 4A and 4B to retain stages of a telescoping body in deployed or stowed configurations, in accordance with various embodiments.

FIG. 4C depicts jack clip 218 of target device 104 in detail and in accordance with various embodiments. Jack clip 218 may comprise mating tab 434 for coupling jack clip 218 to body 210 (of FIG. 4B). Mating tab 434 may be coupled to body 210 using adhesives, fasteners, a recess formed in body 210 to receive mating tab 434, or any other suitable coupling materials or techniques. Spring segment 432 may extend from mating tab 434 with a curved contour. Handle segment 430 may extend from spring segment 432 to facilitate actuation of jack spring 218 by application of pressure. Handle segment 430 may comprise a U-shaped cross section. Lever segment 428 may extend from handle segment 430 to retention segment 427.

In various embodiments, retention segment 427 may comprise a retention wall 422 extending from lever segment 428 at a nonzero angle, a retention floor extending from retention wall 422 at a nonzero angle, a retention wall 424 extending from retention floor 420 at a non-zero angle, and stop tab 426 extending from retention wall 424 at a nonzero angle. In that regard, the segment of jack clip 218 comprising retention wall 422, retention floor 420, and retention wall 424 may have a U-shaped profile.

In various embodiments, retention wall 422 and retention wall 424 may be arranged to engage a surface of neck 400 defining opening 414. The length of retention floor 420 may correspond to a diameter of opening 414 to position retention wall 422 and retention wall 424 at least partially in contact with the perimeter of opening 414 during engagement. Stop tab 426 may prevent retention wall 424 from sliding completely into opening 414. Retention segment 427 of jack spring 218 may slide into opening 414 and resist telescoping action of neck 400 and/or body 210. Jack spring may release neck 400 in response to pressure applied to handle segment 430. Handle segment 430 may translate towards body 210 in response to pressure and may cause bowing of spring segment 432 and translation of retention segment 427 out from opening 414. Jack spring 218 may comprise a metallic material to reduce fatigue with repeated flexion of spring segment 432.

In various embodiments, neck 400 of plunger stage 216 may comprise a U-shaped cross section defining opening 401. Head assembly 402 may fold into neck 400 by pivoting about pin 404 and passing through opening 401 into neck 400. Head assembly 402 may define retention slot 403 configured to engage top clip 406 in a deployed configuration. Head assembly 402 may further define openings 405 similar to openings 414 to reduce weight. Head assembly may be coupled by pins 410 to target assembly 408.

Figure 5A:
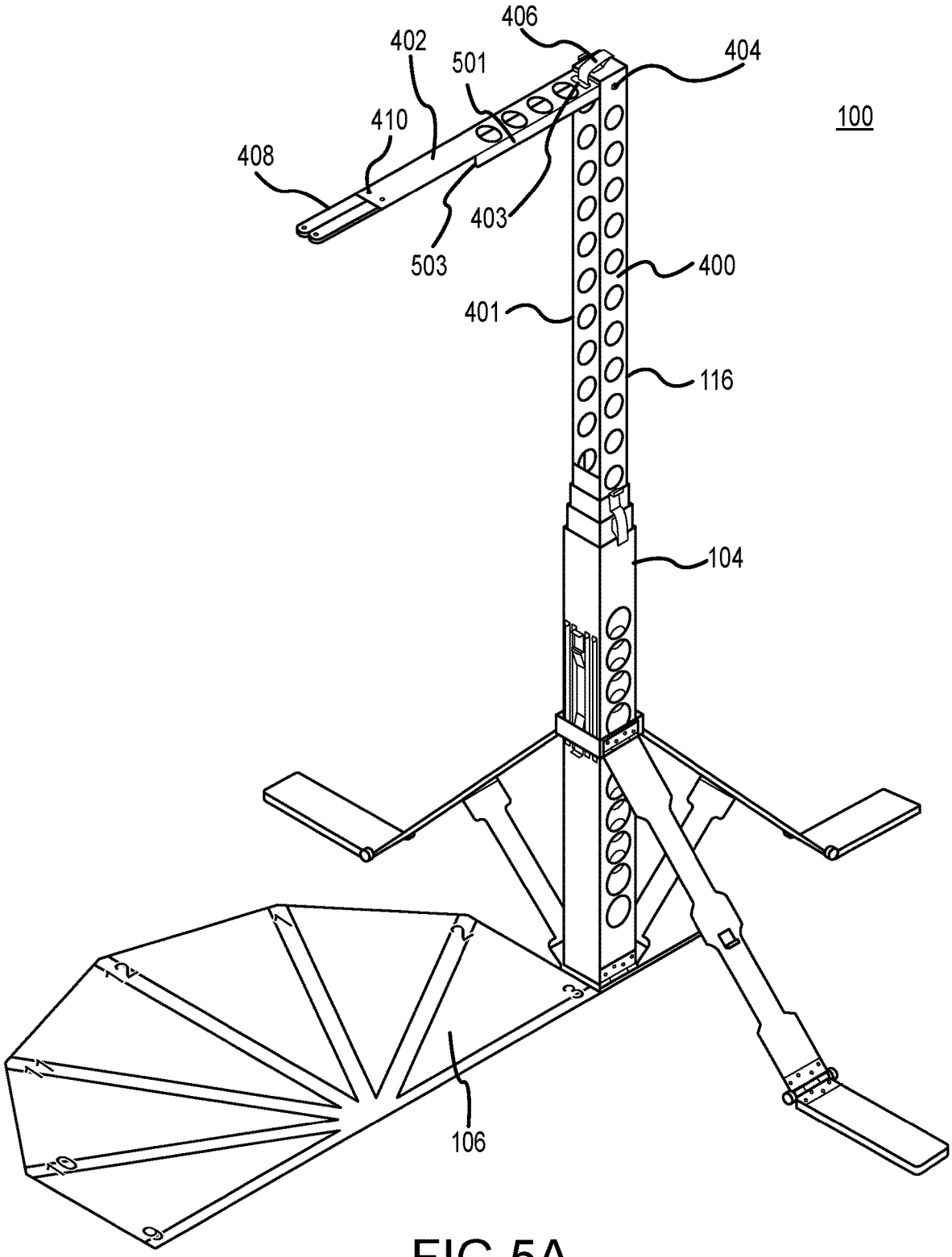
FIG. 5A illustrates a perspective view of a target device with a deployed neck extending from a telescoping body, in accordance with various embodiments.

Referring now to FIG. 5A, target assembly 104 is shown adjacent target mat 106 with head assembly 402 in a deployed configuration protruding from neck 400, in accordance with various embodiments. Head assembly 402 may pivot about pin 404 passing through opening 401 to translate target assembly 408 away from body 210 and into a position above target mat 106. Top clip 406 may engage retention slot 403 to retain head assembly in the deployed configuration and cantilevered from neck 400. Head assembly 402 may extend from neck 400 at a substantially 90-degree angle, or at any other suitable angle to position target assembly 408 over target mat 106. Head assembly 402 may include side surface 501 with cutaway 503 to allow target assembly to pivot about pins 410 and through the opening defined by cutaway 503 into a stowed configuration.

Figure 5B:
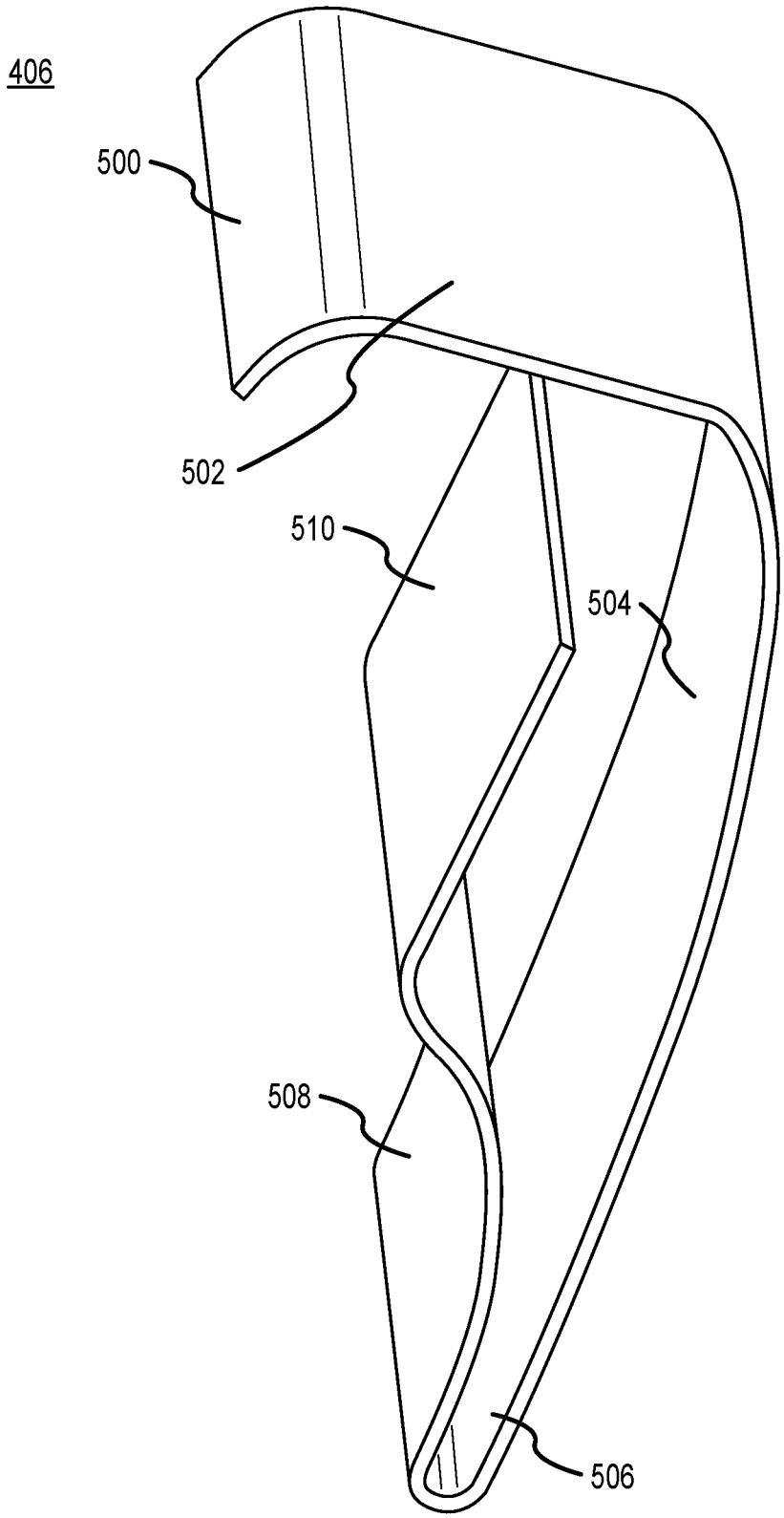
FIG. 5B illustrates a perspective view of a top clip configured to retain a neck of the target device of FIG. 5A in a deployed configuration, in accordance with various embodiments.

FIG. 5B depicts top clip 406 (also depicted in FIG. 5A), in accordance with various embodiments. Top clip 406 may comprise a mating tab 510 suitable for coupling top clip 406 to neck 400 using adhesives, fasteners, a recess formed in neck 400 to receive mating tab 510, or any other suitable coupling materials or techniques. Spring segment 508 may extend from mating tab 510 with a curved contour. Handle segment 506 may extend from spring segment 508 to facilitate actuation of top clip 406 by application of pressure. Handle segment 506 may comprise a U-shaped cross section. Lever segment 504 may extend from handle segment 506 to retention segment 502 with retention hook 500 extending from retention segment 502 at a non-zero angle. Retention hook 500 may be configured to engage retention slot 403 of head assembly 402 to retain head assembly 402 in a deployed configuration relative to neck 400.

In various embodiments, top clip 406 may slide into retention slot 403 to prevent head assembly 402 from pivoting about pin 404 into a stowed position. Top clip 406 may release head assembly 402 by translating retention hook 500 out from retention slot 403 in response to pressure applied to handle segment 506. Handle segment 506 may translate towards neck 400 in response to pressure and may cause spring segment 508 to bow. Retention segment 427 may translate out from retention slot 403 in response to the movement of handle segment 506 and the bowing of spring segment 508. Jack spring 218 may comprise a metallic material to reduce fatigue with repeated flexion of spring segment 432.

Figure 6A:
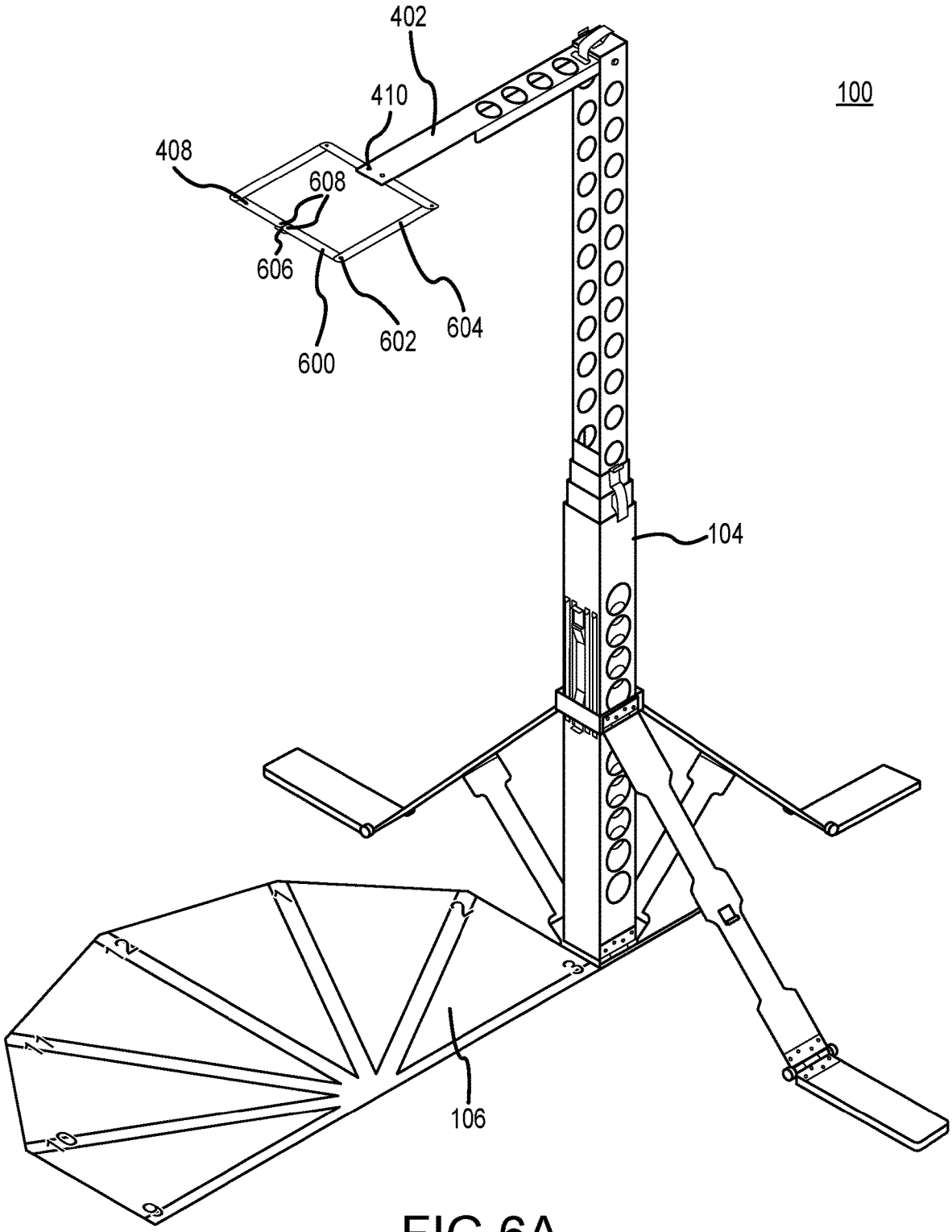
FIGS. 6A and 6B illustrate perspective and top views, respectively, of a target device with a target head deployed over a target mat, in accordance with various embodiments.
Figure 6B:
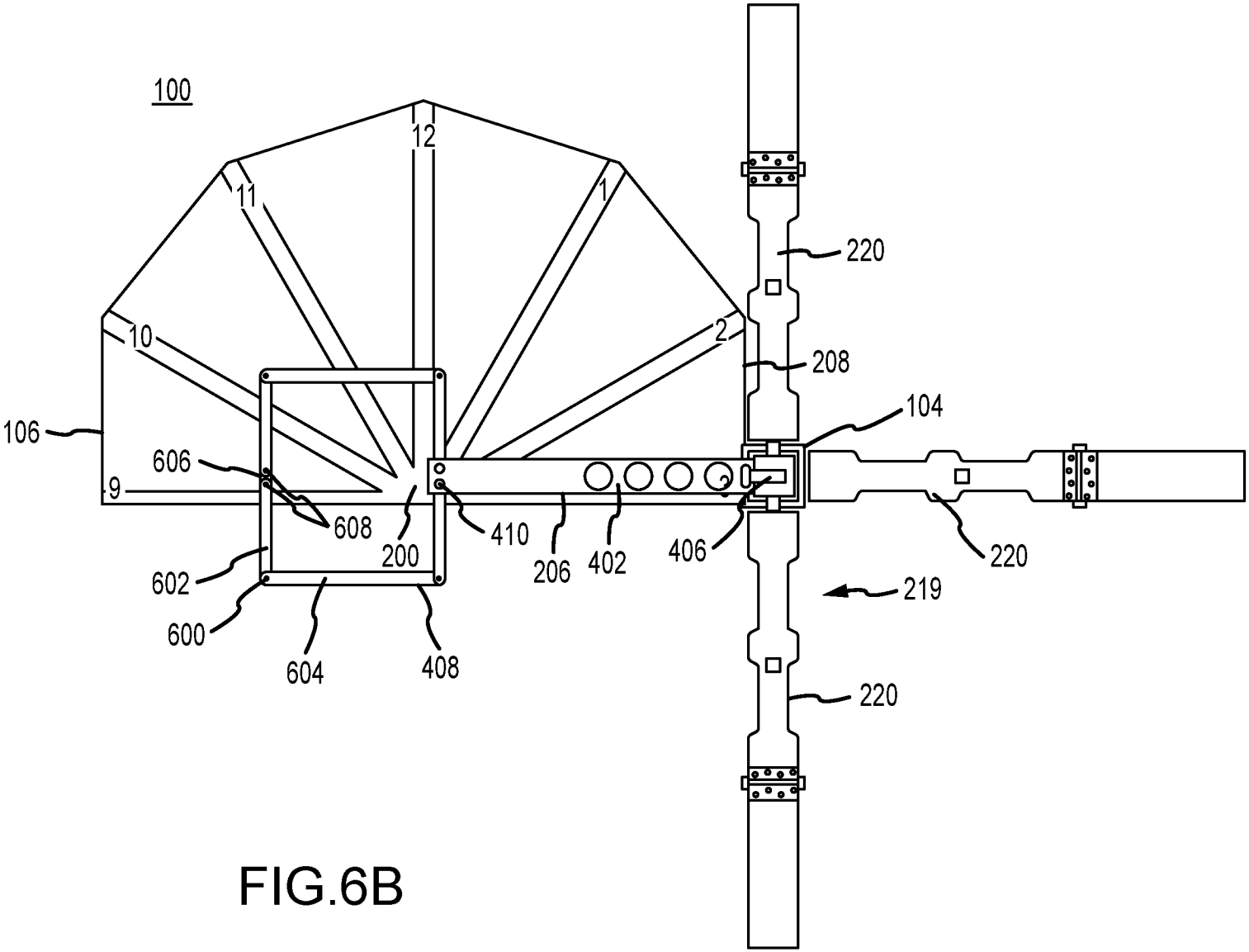

Referring now to FIGS. 6A and 6B, tennis training system 100 is shown with target assembly 408 of target device 104 deployed above target mat 106, in accordance with various embodiments. Target assembly 408 may include short segments 600 coupled to long segments 604 by pins 602. The distal end of the target assembly 408 may comprise a link segment 606 coupled to short segments 600 by pins 608. Target assembly 408 may define an opening through which a tennis ball may pass. The opening defined by target assembly 408 may be square, circular, polygonal, irregular, or any other shape suitable to create a target opening. Although a segmented target assembly 408 is depicted for compact stowing, the target assembly 408 may comprise a rigid structure or less compact stowing structure removably coupled to head assembly 402.

The perspective top view of FIG. 6B depicts target assembly 408 deployed above intersection point 200 of target mat 106. Target mat 106 may be aligned relative to target device 104 such that segment 208 and the radial line 202 extending to 12 o'clock on target mat 106 are substantially parallel to opposing legs 220 of base 219. Edge 206 of target mat 106 may be substantially parallel to head assembly 402 and aligned with the body 210 of target device 104. Three legs 220 of base 219 may extend from the center of training device 104 with two legs 220 opposing one another and forming a substantially 180-degree angle. The two legs 220 opposing one another may also be oriented at a 90-degree angle with head assembly 402. A leg 220 may also be oriented substantially 90 degrees from the opposing legs 220 and substantially 180 degrees from head assembly 402. Although 90-degree angles are depicted, other suitable angles may be formed by legs 220. Base 219 may also include more or fewer than three legs 220.

Figure 7:
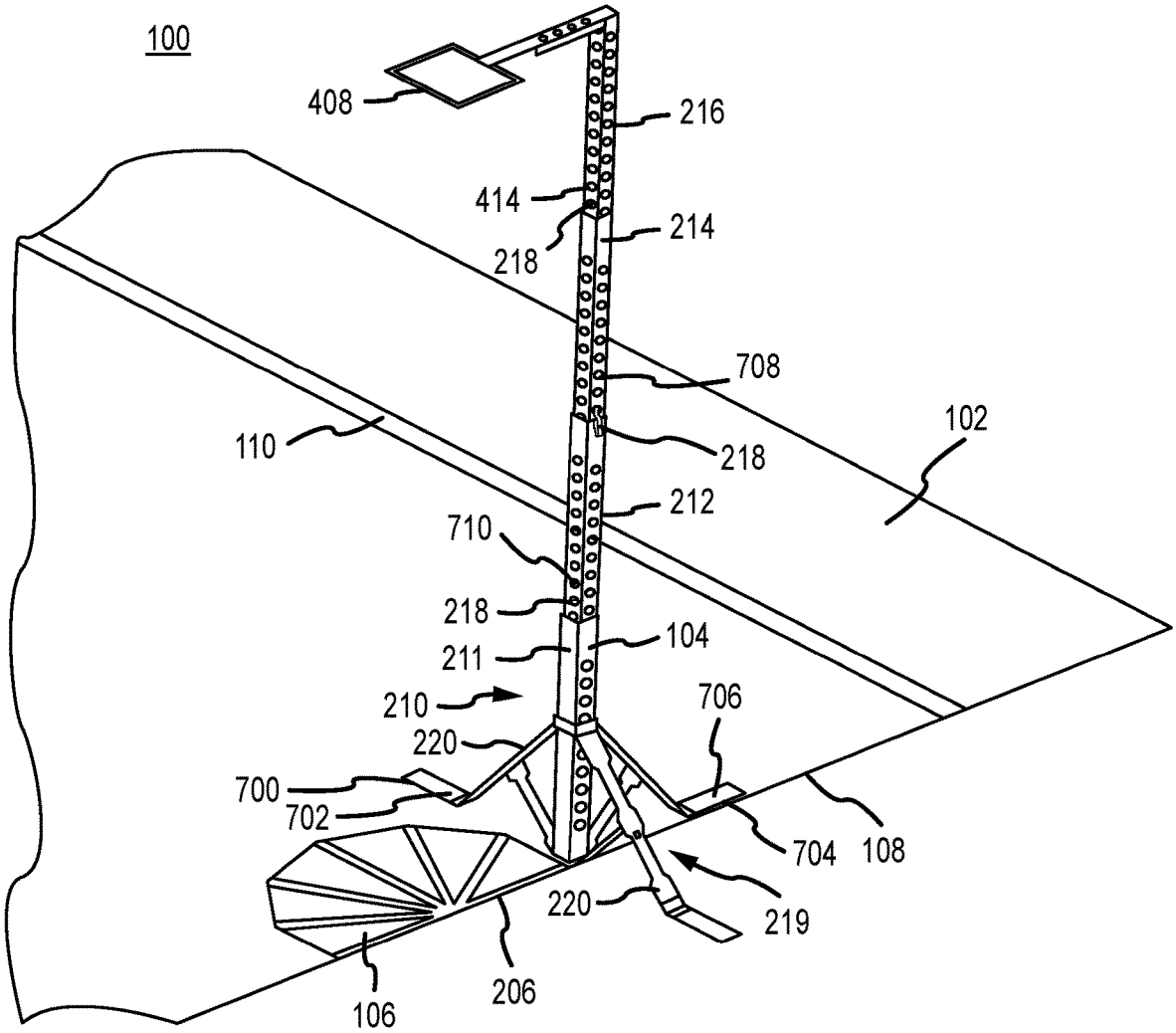
FIG. 7 illustrates a perspective view of a tennis training system fully deployed on a tennis court and aligned inside the baseline and offset from the service line, in accordance with various embodiments.

Referring now to FIG. 7, tennis training system 100 is shown in a fully deployed state, in accordance with various embodiments. Edge 206 of target mat 106 may be parallel to baseline 108 in the deployed state. Target mat 106 may lay adjacent baseline 108 without covering baseline 108, partially covering baseline 108, or completely covering a section of baseline 108. Target mat 106 may be disposed approximately two feet from service line 112 along baseline 108, though other alignments and distances may also be suitable for training.

In various embodiments, target device 104 may be aligned with and adjacent to target mat 106, in accordance with various embodiments. Opposing legs 220 of base 219 may be substantially parallel to sideline 110 with foot 702 of leg 220 offset from sideline 110 towards service line 112. Opposing legs 220 may extend from body 210 at substantially 180 degrees relative to one another to leave area beneath target assembly 408 and above target mat 106 substantially free from obstruction for a tennis player practicing a serve. Foot 706 of base 219 may have edge 704 parallel to baseline 108. Edge 704 may also be aligned with an edge of baseline 108 and/or edge 206 of target mat 106.

In various embodiments and in a deployed state, body 210 may extend from tennis court 102 vertically with the height of target assembly 408 selectable by choosing the distance each stage of body 210 extends from the previous stage. Openings 710 defined in first inner stage 212 and openings 708 defined in second inner stage 214 may be similar to openings 414 formed in plunger stage 216 and described above. A jack clip 218 may engage any opening 710 formed in first inner stage 212 to retain first inner stage 212 at a desired height relative to outer stage 211. Similarly, a jack clip 218 may engage any opening 708 formed in second inner stage 214 to retain second inner stage 214 at a desired height relative to first inner stage 212. A jack clip 218 may also engage any opening 414 formed in plunger stage 216 to retain plunger stage 216 at a desired height relative to second inner stage 214. The total height of body 210, and thus the height of target assembly 408, may be set by selectively deploying the stages of body 210 to the desired height.

In various embodiments, target device 104 may stand without human support in the deployed configuration. Target device 104 may also leave the area under target assembly 408 substantially free from obstructions. A player may align behind the baseline as though serving a ball, toss the ball towards, into, or through target assembly 408, and allow the ball to land on target mat 106 without completing the serve. A player may also strike the serve as desired without allowing the ball to land on target mat 106. Target assembly 408 gives feedback as to whether the trajectory of their toss is correct based on whether the ball passes through target assembly 408. Target mat 106 aligned on tennis court 102 adjacent target device 104 is oriented beneath target assembly 408 to give feedback at the end of the tennis toss based on where the ball lands on target mat 106. For example, an acceptable toss may travel into target assembly 408 then land on target mat 106 in the area defined by radial lines 202 extending to 11 and 1 o'clock as depicted in FIG. 2A.

Figure 8:
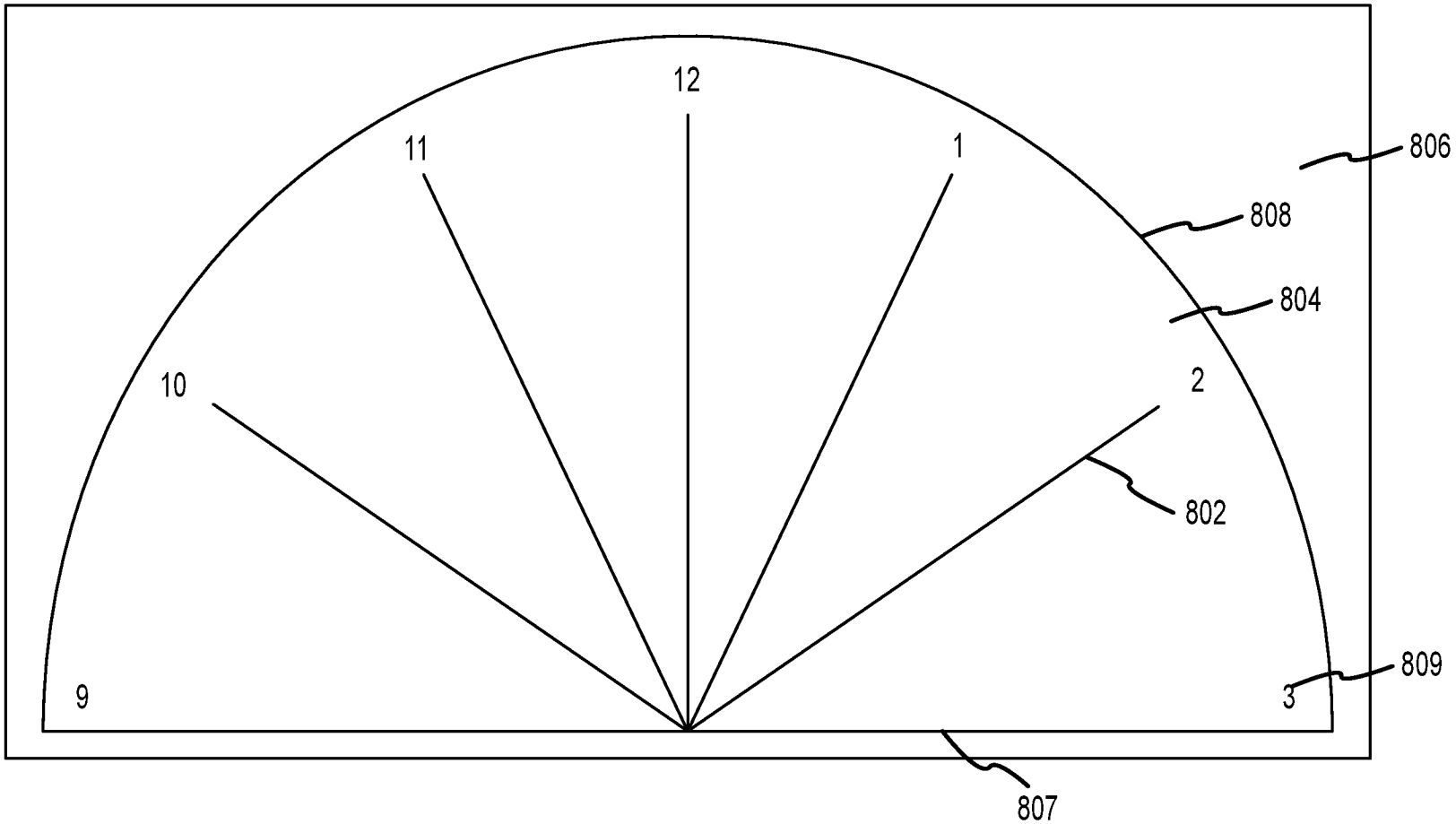
FIG. 8 illustrates a target mat having rounded segments between radial lines formed on a mat having a rectangular perimeter, in accordance with various embodiments.

Referring now to FIG. 8, a target mat 806 is shown having rectangular outer perimeter with rounded segments 808 between radial lines 802 printed on or formed in a surface of target mat 806, in accordance with various embodiments. Numbers 809 may also be printed on or formed in target mat 806 and disposed at a distal end of radial lines 802. Edge 807 may also be printed on or formed in target mat 806 opposite the semi-circular edge formed by rounded segments 808. The features printed on or formed in target mat 806 may thus resemble the upper half of a clock. Target mat 806 has features similar to target mat 106 depicted in FIGS. 1-7, and target mat 806 may be used interchangeably with target mat 106 in training system 100.

Tennis training systems and devices described herein enable tennis players to train effectively with or without a coach. The self-supporting nature of target device 104 results in repeatable and reliable feedback for the training player or coach. Target device 104 is insusceptible to movements associated with a person manually holding a target. Tennis training system 100 stows into a compact configuration to enable movement for a player training alone or a coach moving the system. The indicators of success (i.e., ball passing through target opening and landing on target mat) offered by tennis training systems of the present disclosure are easily discernable even by novice players, so players of any skill level can use the tennis training system to improve on their own.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Devices, systems, and methods are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or device that comprises a list of elements does not include only those elements but may include other elements not expressly listed or inherent to such process, method, article, or device.

What is claimed is:

1. A tennis training system comprising:
- a target mat including:
  - an intersection point; and
  - a plurality of radial lines extending from the intersection point to visibly define sections on the target mat;
- a target device configured to align with the target mat and including:
  - a body, wherein the body comprises a telescoping mechanism including an outer stage, an inner stage, and a plunger stage;
  - a target assembly coupled to a first end of the body and configured to define a target opening; and
  - a base coupled to a second end of the body opposite the first end, wherein the base comprises:
    - a bracket configured to slide along the body between a first position and a second position;
    - a leg hingedly coupled to the bracket, wherein the leg translates into a deployed configuration in response to the bracket translating into the second position; and
    - a retention clip coupled to the body and configured to retain the bracket in the second position, wherein the retention clip comprises:
    - a spring segment; and
    - a retention segment coupled to the spring segment, wherein retention segment releases the bracket in response to the retention segment translating towards the body.

2. The tennis training system of claim 1, wherein the base further comprises a support member hingedly coupled to the body and hingedly coupled to a central portion of the leg.

3. The tennis training system of claim 1, wherein the plunger stage comprises:
- a neck slidably engaged with the inner stage; and
- a head assembly with a first side of the head assembly pivotally coupled to the neck, wherein the target assembly is disposed at a second end of the head assembly.

4. The tennis training system of claim 3, wherein the head assembly is cantilevered from the neck to position the target opening over the target mat in a deployed configuration.

5. A target device comprising:
- a body;
- a head assembly coupled to a first end of the body and configured to define a target opening;
- a bracket configured to translate along the body from a first position to a second position; and
- a first leg hingedly coupled to the bracket, wherein the first leg translates into a deployed configuration in response to the bracket translating into the second position; and
- a retention clip coupled to the body and configured to retain the bracket in the second position, wherein the retention clip further comprises:
- a spring segment; and
- a retention segment coupled to the spring segment, wherein the retention clip is configured to release the bracket in response to the retention segment translating towards the body.

6. The target device of claim 5, wherein the body comprises a square cross section.

7. The target device of claim 5, further comprising a second leg hingedly coupled to the bracket, wherein the second leg translates into the deployed configuration in response to the bracket translating into the second position, and wherein the second leg protrudes from the body at a 90-degree angle relative to the first leg in the deployed configuration.

8. The target device of claim 5, further comprising a foot hingedly coupled to a distal end of the first leg.

9. The target device of claim 8, wherein the foot comprises:

a cuboid comprising a metal; and a layer of rubber disposed over the cuboid.

10. The target device of claim 9, wherein the body comprises a polymer.

11. The target device of claim 5, wherein the body comprises a telescoping mechanism including:

an outer stage;

an inner stage disposed at least partially in the outer stage; and a plunger stage disposed at least partially in the inner stage.

12. The target device of claim 11, wherein the plunger stage comprises:

a neck pivotally coupled to the head assembly and slidably engaged with the inner stage; and a target assembly disposed at a distal end of the head assembly and defining the target opening in a deployed configuration.

13. The target device of claim 12, further comprising a top clip coupled to a distal end of the neck, wherein the top clip is configured to retain the head assembly cantilevered from the neck.

* * * * *